US005760669A

United States Patent [19]

Dangler et al.

[11] Patent Number: 5,760,669

[45] Date of Patent: Jun. 2, 1998

[54] LOW PROFILE INDUCTOR/TRANSFORMER COMPONENT

[75] Inventors: Willard K. Dangler; Steven R. Bodenstedt; Bruce R. Waring, all of Yankton, S. Dak.

[73] Assignee: Dale Electronics, Inc., Columbus, Nebr.

[21] Appl. No.: 736,333

[22] Filed: Oct. 23, 1996

Related U.S. Application Data

[63] Continuation of Ser. No. 349,038, Dec. 3, 1994, abandoned.

[51] Int. Cl.[6] ..... H01F 27/06; H01F 27/29

[52] U.S. Cl. ..... 336/65; 336/83; 336/192; 336/212

[58] Field of Search ..... 336/65, 192, 83, 336/212

[56] References Cited

U.S. PATENT DOCUMENTS

| | | | |
|---|---|---|---|
| 3,510,858 | 5/1970 | Flanagan | 336/83 |
| 3,603,917 | 9/1971 | Owen | 336/65 |
| 3,859,614 | 1/1975 | Reithmaier | 336/192 |
| 3,990,030 | 11/1976 | Chamberlain | 336/65 |
| 4,427,961 | 1/1984 | Suzuki | 336/83 |
| 4,498,067 | 2/1985 | Kumakawn et al. | 336/65 |
| 4,516,103 | 5/1985 | Arnold | 336/65 |
| 4,754,370 | 6/1988 | DeTizio et al. | 336/65 |
| 4,769,625 | 9/1988 | Meindl | 336/83 |
| 4,888,571 | 12/1989 | Kobayashi et al. | 336/83 |
| 5,015,981 | 5/1991 | Lint et al. | 336/65 |
| 5,212,345 | 5/1993 | Gutierrez . | |
| 5,359,313 | 10/1994 | Watanabe . | |

FOREIGN PATENT DOCUMENTS

| | | | |
|---|---|---|---|
| 60-208808 | 10/1985 | Japan | 336/65 |
| 1407501 | 9/1975 | United Kingdom | 336/83 |

OTHER PUBLICATIONS

AT&T Improved Coil Bobbin—Dickens, et al. Technical Digest No. 76, Mar. 1988, pp. 19 & 20, 336–192.

*Primary Examiner*—Thomas J. Kozma
*Attorney, Agent, or Firm*—Zarley, McKee, Thomte, Voorhees, & Sease

[57] ABSTRACT

A low profile, low cost, high performance inductor/transformer component having a wire coil within a core set which is disposed at least partially within a recess in a header. The header includes projections extending from it which form terminals when wire leads from the coil are wrapped around them.

22 Claims, 3 Drawing Sheets

LOW PROFILE INDUCTOR/TRANSFORMER COMPONENT

This is a continuation of application Ser. No. 08/349,038 filed on Dec. 3, 1994, now abandoned.

BACKGROUND OF THE INVENTION

1. Field of the Invention

The present invention relates to low profile electronic components. More particularly, the present invention relates to low profile, low cost, high performance inductor/transformer components.

2. Problems in the Art

There is a need in the electronics industry for low profile, low cost, and high performance components. Applications such as PCMCIA cards, portable computers, and other electronic devices with a very limited available space require manufacturers to supply components such as these.

Low profile electronic components exist in the prior art, but most low profile designs are centered around "planer" designs formed from alternate layers of insulating material and copper foil or techniques involving coils formed on multiple layers of printed circuit board materials. These prior art designs involve a high cost and also have production disadvantages.

Other prior art designs for low profile applications include using toroids. While toroid designs are electrically efficient, they are very labor intensive to wind and terminate.

Traditional inductor/transformer coil leads are terminated at a separate metallic terminal which is molded into the header. "Molded-in" terminals will increase the cost of the header by two to three times. This prior art design requires a separate soldered connection internal to the component. These mechanical connections create a point in the component where a failure can occur, resulting in a product with a lower inherent reliability.

FEATURES OF THE INVENTION

A primary feature of the present invention is the provision of a low profile, high performance inductor/transformer component.

A further feature of the present invention is the provision of a low profile inductor/transformer component having a core mounted at least partially within the frame of the supporting header.

A further feature of the present invention is the provision of a low profile inductor/transformer utilizing a self supporting winding, therefore eliminating the need for a bobbin. A further feature of the present invention is the provision of a low profile inductor/transformer component which is bonded together with an epoxy adhesive.

A further feature of the present invention is the provision of a low profile inductor/transformer component having a ferrite core that can be formed in a plurality of different shapes.

A further feature of the present invention is the provision of a low profile inductor/transformer component having wire wrapped terminals, eliminating the need for a metallic terminal formed in the header.

A further feature of the present invention is the provision of a low profile inductor/transformer component suitable for use in PCMCIA cards, portable or notebook computers, DC-DC converter circuits for battery operated equipment, and other products requiring very high packaging density.

A further feature of the present invention is the provision of a low profile inductor/transformer component which can be readily assembled with automated production techniques.

These as well as other features of the present invention will become apparent from the following specification and claims.

SUMMARY OF THE INVENTION

A low profile inductor/transformer component of the present invention includes a header having a plurality of projections, a core set, and a pre wound coil of wire. The header is formed from a single piece of molded plastic. A recess is formed in the header for receiving a portion of the core set. A wire coil is disposed between a lower core half and an upper core half. The core set is disposed in the recess of the header and the entire assembly is bonded together with an adhesive. The low profile of the present design is partly achieved by inserting the core set into the recess of the header.

Terminals are formed by the projections extending from the header and wire leads that extend from the wire coil. The wire leads are first wrapped around the header projections and then emersed in molten solder. The terminals formed on the header projections provide a vary low cost termination, and also eliminate the need of molded in metallic terminals which are present on many prior art headers.

The completed component can be mounted on a printed circuit board in a number of different ways including being mounted on the PC board surface and being mounted through the PC board surface. Also, any number of core set shapes can be used with the present invention.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
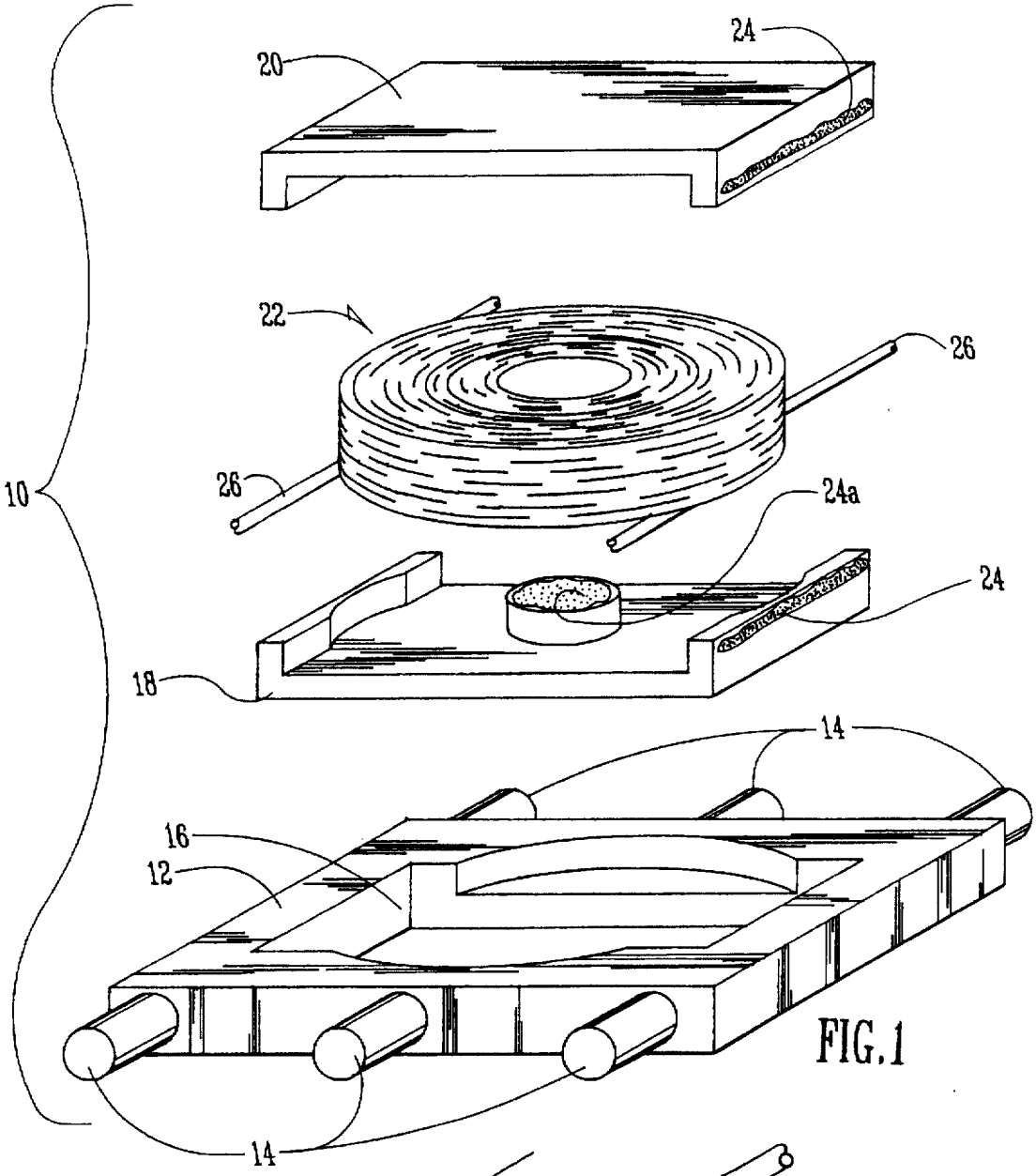
FIG. 1 is an exploded view of one embodiment of the present invention.

FIG. 1 shows an exploded view of a component 10 of the present invention. The component 10 is made by first providing a header 12. The header 12 is comprised of a single piece of a molded plastic material. The plastic material is selected to withstand the high temperature involved (greater than 230° C.) in the component manufacturing process and in the user's printed circuit board assembly process. The header 12 includes a plurality of projections 14 that extend from the header 12. The projections 14 are used in forming component terminals. The header 12 includes a recess 16 which is formed so that a lower core-half 18 can be received by the recess 16. The header design is very inexpensive to produce in volume through standard industry molding techniques.

The low profile of the overall component 10 is achieved by extending a portion of the core set through the header 12.

Using this technique, the maximum height of the component 10 is determined by the required height of a vertically stacked core set. As shown in FIG. 1, the lower core-half 18 is disposed in recess 16 and extends at least partially through header 12. The lower core-half 18 is matingly similar to an upper core-half 20 which is disposed above the lower core-half 18. Disposed between the lower core-half 18 and the upper core-half 20 is a pre-wound coil 22. An adhesive 24 is utilized to bond the assembly together after the header 12, lower core-half 18, upper core-half 20, and coil 22 are assembled. The component 10 is bonded together with adhesive 24 by covering an area at the adjoining line of the two core-halves and the joining line between the lower core-half 18 and the header 12. FIG. 1 also shows an alternative location for the bonding adhesive 24A when center leg gapped cores are used in the component 10. Adhesive bonded construction provides a sturdy component with all the materials bonded together. The bonded construction will also eliminate the "hum" in the transformer or inductor windings which is a common complaint.

Figure 4:
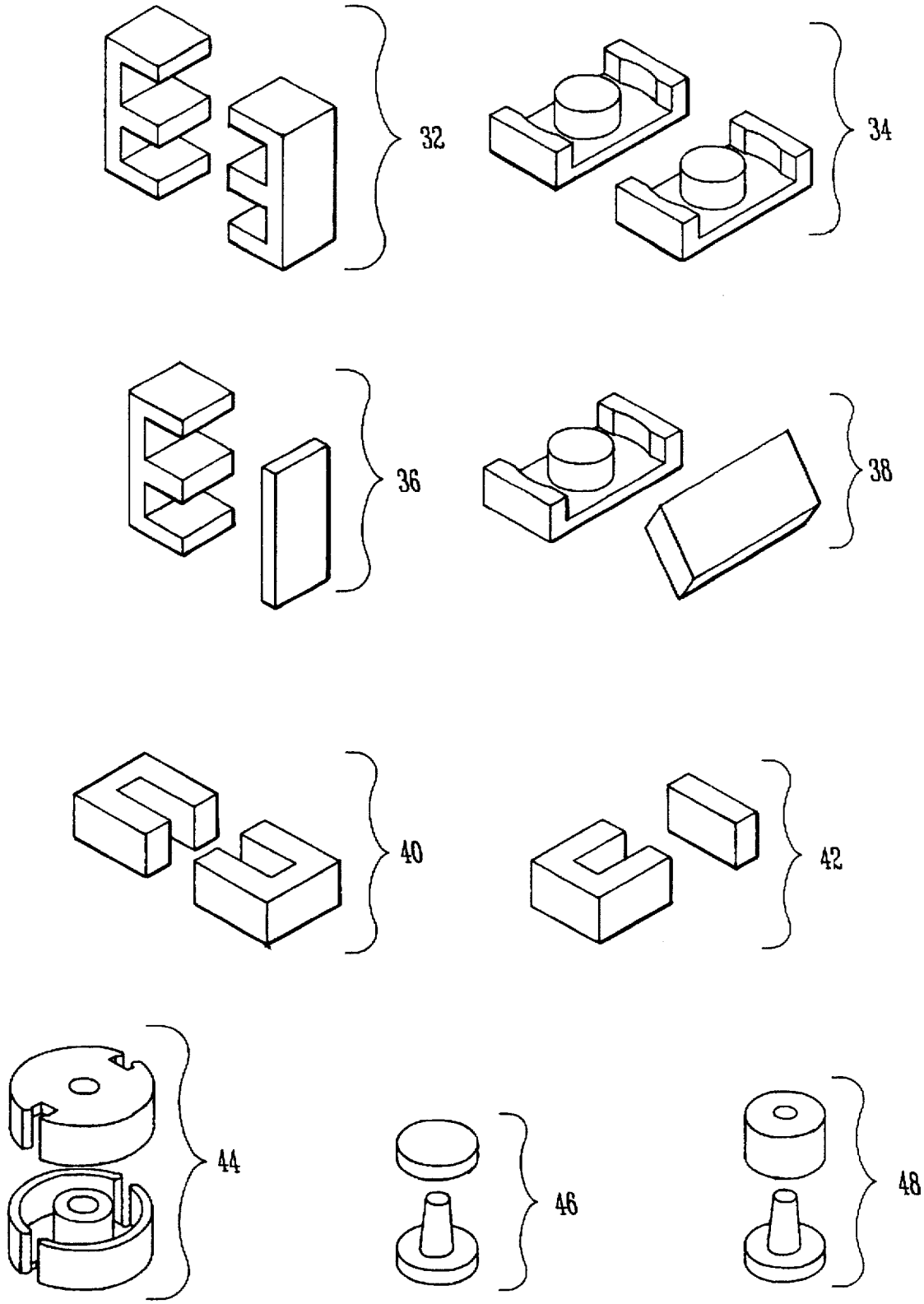
FIG. 4 shows alternative shapes of the ferrite core of the present invention.

The basic design of the lower core-half 18 and upper core-half 20 of the present invention can take on a wide variety of core styles and core materials. FIG. 4 shows several examples of possible core designs including, but not limited to, E—E 32, ER 34, ER-I 38, E-I 36, C—C 40, C-I 42, Pot 44, Tack-Disk 46, and Tack-Cup 48 cores. Any core set that is capable of being assembled around pre-wound coils could be used in the present invention.

A variety of materials may be selected for the cores of the present invention, but the preferred choice will most often be ferrite due to its inherent properties. The most common applications of the low profile components 10 are DC-DC converter circuits, which typically require the choice of a ferrite core material. In addition, ferrite has the capability of being formed in complex shapes. Also, when used with gapped cores, ferrite is the most desirable core material for use in a DC-DC converter.

The windings of the coils 22 in the present invention are designed to be self-supporting, perfectly layered coils in order to provide the best volumetric efficiency. Also, the traditional bobbin formerly used in similar designs, is eliminated in order to lower the volume requirements within the winding window, reduce the height, and to lower the material cost. The coils 22 of the present invention can be produced on existing automated equipment which can provide a high volume of production with a very low labor cost. Individual windings may be designed to utilize the most desirable wire size depending on the electrical requirements of the circuit. Previously, automatically wound transformers and the like were designed with one wire size to obtain the lowest component cost. As shown in FIG. 1, each coil includes a plurality of wire leads 26 extending from the coil 22. Each wire lead 26 will be connected to a header projection 14 to form a terminal.

Figure 2:
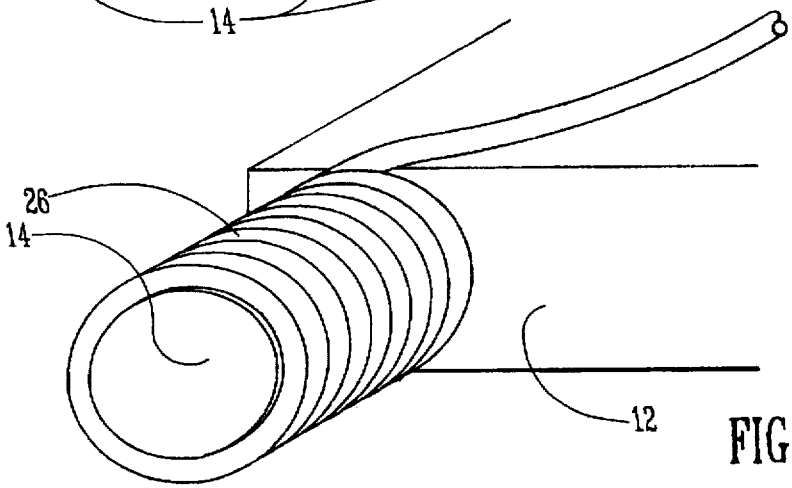
FIG. 2 shows an enlarged view of one of the terminals formed by a header projection and a wire lead.

FIG. 2 shows how the terminals of the present invention are formed. Each wire lead 26 from the pre-wound coil 22 forms a termination on the appropriate header projection 14. The wire lead 26 is wrapped around the terminal projection 14 in a "spring" shape. When this "spring" shaped termination is immersed in molten solder, the wire insulation is melted from the wire. The "spring" is tinned into a continuous cylindrical shape which forms the terminal.

The wire wrapped terminals may be formed over header projections 14 that have a multitude of shapes. For example, the header projections could have a circular, oval, rectangular, square, trapezoidal, or any other cross section. Different shapes of projections 14 provide different advantages in presenting different profiles to the automated winder and to the printed circuit board surface that the component is mounted upon. Typically, the number of terminals on a component may vary from four to twelve on components incorporating this basic style of design. Of course, other designs may include a different number of terminals.

The wire wrapped terminals of the present invention allow for the use of a low cost header and also provide a very lost cost termination. The cost of the termination is low since a separate metallic terminal does not need to be molded into the header 12. The cost of a "molded-in" terminal will increase the cost of a header significantly. These wire wrapped terminals also have the advantage of eliminating one mechanical connection for each terminal on the component 10. This is because on a traditional molded-in terminal, a connection must be made between the coil lead and the molded metallic terminal.

The inductor/transformer design of the present invention with the header 12, windings 22, core set 18 and 20, and terminations can be readily assembled with automated production techniques. The winding 22 can be automatically wound on existing winding equipment. The header 12, core set 18 and 20, and winding 22 can be semi-automatically assembled on automated equipment. The bonding adhesive 24 can be applied through automatic dispensing equipment. The terminations can also be automatically completed with equipment that is similar to traditional "wire wrap" equipment.

Figure 3A:
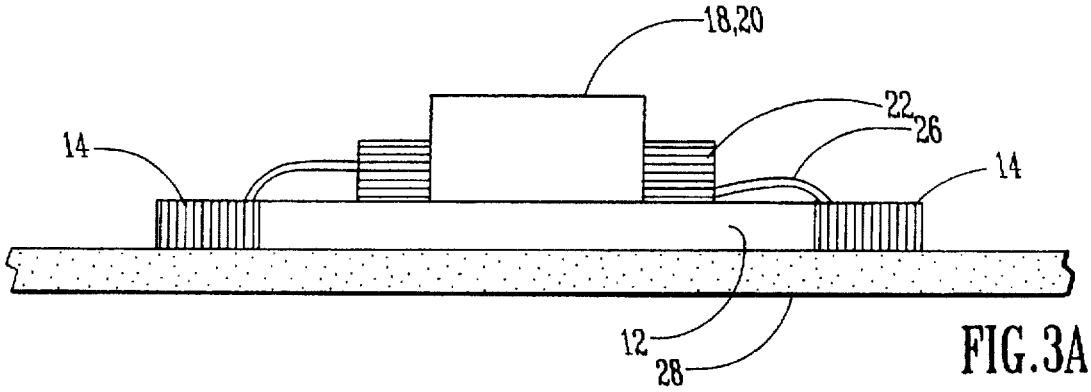
FIG. 3 shows side views of alternative methods for mounting the present invention on a printed circuit board.
Figure 3B:
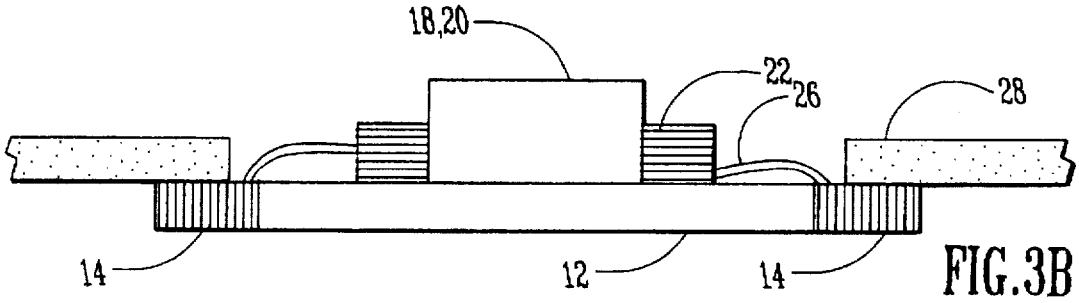
Figure 3C:
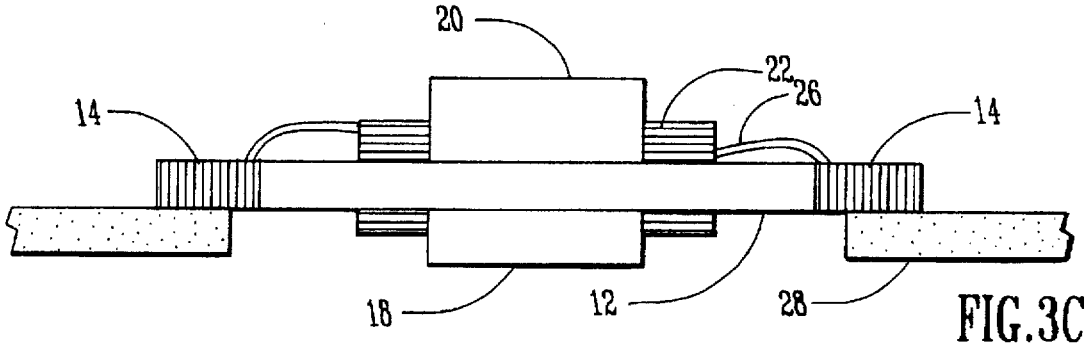
Figure 3D:
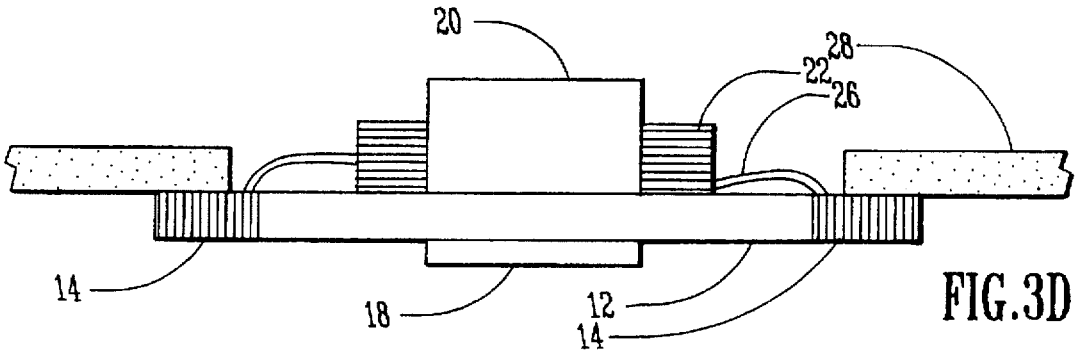

The design of the present invention allows the component 10 to be mounted on a printed circuit board (PCB) 28 in a variety of ways. FIG. 3 shows some examples of different mounting configurations. For example, the component can be mounted on the PCB surface (FIG. 3A), through the PCB surface (FIG. 3B), or in an alternate component form projecting through the PCB with the terminal portions of the component mounted on either surface of the PCB (FIG. 3C, 3D).

When the present invention is applied to a transformer, a desirable performance, with truly isolated windings, is readily achieved with this component design. Very few manufacturers are currently offering truly low-profile transformers that can be used in the DC-DC converter circuits of PCMCIA Type II applications. Isolated windings offer a significant advantage since both positive and negative voltages need to be generated from a single voltage source. The degree of isolation may be increased by coating the cores with an insulating material such as paylene and by adding insulating "washers" of dielectric material such as mylar between wound coils during assembly.

The present invention is designed to have a maximum volumetric efficiency, a very low profile, and a relatively high current handling capacity. Preferably, the components of the present invention are manufactured with automated equipment and have a low cost of raw materials. The materials are carefully selected to withstand the rigorous environment encountered by surface mount components during their manufacturing process and their product life cycle.

What is claimed is:

1. A low profile electronic component comprising:

a header having a recess formed within said header, said header forming a plurality of projections extending from said header and being generally parallel to said header, said projections being formed from the same material as the header;

first and second opposing core members forming a core set, said core set being at least partially disposed within said recess;

a pre-wound coil disposed at least partially within said core set such that the pre-wound coil is insertable into the first core member and held in place by the second core member, said pre-wound coil having a plurality of wire leads; and at least one of said wire leads being wrapped around one of said projections to form a conductive surface on said projection to form a component terminal.

2. The low profile electronic component of claim 1 wherein said header and said core set are bonded together with an adhesive.

3. The low profile electronic component of claim 1 further comprising a layer of solder disposed over at least a portion of said component terminal.

4. The low profile electronic component of claim 1 wherein said pre-wound coil is comprised of at least two wires electromagnetically coupled together to form a transformer.

5. The low profile electronic component of claim 1 wherein said pre-wound coil includes a wire coil to form an inductor.

6. The low profile electronic component of claim 1 wherein said projections extend outward generally parallel to said header allowing said component to form a surface mount component.

7. The low profile electronic component of claim 1 wherein said header is made from a plastic material capable of withstanding temperatures of at least 230° C.

8. The electronic component of claim 1 wherein said first and second core members are made from a ferrite.

9. The low profile electronic component of claim 1 wherein said projections have a rectangular cross-section.

10. The low profile electronic component of claim 1 wherein said projections have an oval cross-section.

11. The low profile electronic component of claim 1 wherein said projections have a trapezoidal cross-section.

12. The low profile electronic component of claim 1 wherein said pre-wound coil is a self-supporting coil.

13. The low profile electronic component of claim 1 wherein said recess extends entirely through said header.

14. A low profile surface mount electronic component comprising:

a flat header having a top and bottom surface and a plurality of edges, said header having a recess formed in a said top surface;

a plurality of non-conductive projections extending from at least one of said edges of said header generally parallel to said bottom surface of said header, said projections being formed from the same material as the header;

first and second core members forming a core set, said core set being at least partially disposed within said recess, wherein the first core member has a first surface and the second core member has a second surface parallel to and facing the first surface.;

at least one self-supporting coil disposed at least partially within said core set between the first and second surfaces such that the combination of the first and second surfaces secure the self-supporting coil in place, each of said at least one self-supporting coils having at least one wire lead; and at least one of said wire leads being wrapped around one of said projections to form a conductive surface on said projection in order to form a surface mount terminal for the component.

15. The low profile surface mount electronic component of claim 14 further comprising a layer of solder disposed on said conductive surface.

16. The low profile surface mount electronic component of claim 14 wherein each of said projections is positioned perpendicular to the edge from which it extends.

17. The low profile surface mount electronic component of claim 16 wherein said projections are parallel to said bottom surface.

18. The low profile surface mount electronic component of claim 14 wherein at least one of the core members defines an outer surface of the component.

19. The low profile electronic component of claim 1 wherein at least one of the core members defines an outer surface of the component.

20. The low profile electronic component of claim 1 wherein said projections are non-conductive.

21. A low profile surface mount electronic component comprising:

a flat header having a top and bottom surface and a plurality of edges, said header having a recess formed in a said top surface;

a plurality of non-conductive projections extending from at least one of said edges of said header generally parallel to said bottom surface of said header, said projections being formed from the same material as the header;

first and second core members forming a core set, said core set being at least partially disposed within said recess;

at least one pre-wound self-supporting coil having top and bottom surfaces perpendicular to an axis of the coil, said coil disposed at least partially within said core set with the bottom surface of the coil placed against the first core member and the second core member placed against the top surface of the coil to hold the coil in place, each of said at least one pre-wound coils having at least one wire lead; and at least one of said wire leads being wrapped around one of said projections to form a conductive surface on said projection in order to form a surface mount terminal for the component.

22. A low profile surface mount electronic component comprising:

a flat header having a top and bottom surface and a plurality of edges, said header having an opening formed through the top and bottom surfaces of the header;

a plurality of non-conductive projections extending from at least one of said edges of said header generally parallel to said bottom surface, said projections being formed from the same material as the header;

a first and second core member forming a core set, said core set being at least partially disposed within said opening, said opening being sized to allow the entire core set to be received through the opening;

at least one pre-wound coil disposed at least partially within said coil set, each of said at least one pre-wound coils having at least one wire lead; and at least one of said wire leads being wrapped around one of said projections to form a conductive surface on said projection in order to form a surface mount terminal for the component.

* * * * *